US007766512B2

(12) United States Patent
Chou et al.

(10) Patent No.: US 7,766,512 B2
(45) Date of Patent: Aug. 3, 2010

(54) LED LIGHT IN SEALED FIXTURE WITH HEAT TRANSFER AGENT

(75) Inventors: Der Jeou Chou, Mesa, AZ (US); James Richardson, Mesa, AZ (US)

(73) Assignee: Enertron, Inc., Tempe, AZ (US)

( * ) Notice: Subject to any disclaimer, the term of this patent is extended or adjusted under 35 U.S.C. 154(b) by 433 days.

(21) Appl. No.: 11/837,340

(22) Filed: Aug. 10, 2007

(65) Prior Publication Data

US 2008/0186704 A1 Aug. 7, 2008

Related U.S. Application Data

(60) Provisional application No. 60/822,199, filed on Aug. 11, 2006.

(51) Int. Cl.
*F21V 29/00* (2006.01)

(52) U.S. Cl. ..... 362/294; 362/249.02; 362/311.02; 362/373

(58) Field of Classification Search ..... 362/218, 362/249.02, 294, 311.02, 373, 800; 313/46, 313/498

See application file for complete search history.

(56) References Cited

U.S. PATENT DOCUMENTS 7,549,772 B2 * 6/2009 Wang ..... 362/294
2005/0174780 A1 * 8/2005 Park ..... 362/294

* cited by examiner

*Primary Examiner*—Stephen F Husar
(74) *Attorney, Agent, or Firm*—Robert D. Atkins

(57) ABSTRACT

An LED light system has an LED light module for inserting into a standard fixture. The fixture has a housing and cover for sealing the enclosure. The LED module contains a shell or outer surface having a matching form factor as the housing for making physical contact with the housing over a sufficient surface area to provide good thermal contact. A substrate is mounted on a support structure. A plurality of LEDs is disposed on the substrate. A heat transfer agent or medium transfers heat from the LEDs to the housing. The outer surface of the LED module spreads the heat over its surface area and firmly contacts the surface of the housing for good thermal transfer. The heat transfer medium is made of a thermally conductive material such as aluminum or copper and formed to contact a surface area of the LED module.

27 Claims, 9 Drawing Sheets

LED LIGHT IN SEALED FIXTURE WITH HEAT TRANSFER AGENT

CLAIM TO DOMESTIC PRIORITY

The present non-provisional patent application claims priority to provisional application Ser. No. 60/822,199, entitled "LED Light in an Enclosed or a Submersible Light Fixture," and filed on Aug. 11, 2006.

FIELD OF THE INVENTION

The present invention relates in general to lighting products and, more particularly, to a sealed fixture enclosing a light-emitting diode (LED) light source with a heat transfer agent or medium to dissipate heat from the LEDs to the fixture.

BACKGROUND OF THE INVENTION

LEDs are known for use in general lighting applications to provide a highly efficient and long-lasting light, sufficient to illuminate an area in home, office, or commercial settings. A single LED can produce a bright light in the range of 1-5 watts and emit 55 lumens per watt with a life expectancy of about 100,000 hours. The total luminance increases by using a light engine having banks or arrays of LEDs.

The light engine typically includes a high thermal conductivity substrate, an array of individual LED semiconductor devices mounted on the substrate, and a transparent polymeric encapsulant, e.g., optical-grade silicone, deposited on the LED devices.

The LED must maintain its junction temperature in the proper rated range to maximize efficacy, longevity, and reliability. The enclosure of the light engine must provide for dissipation of the heat generated by the LEDs. Many LED lights are housed within finned fixtures. The fins dissipate the heat to ambient surroundings. LED lighting finds many uses for indoor applications or settings that are not subject to weather elements. However, the air-cooled finned fixtures are not suitable for outdoor applications, which are subject to moisture or that must otherwise be sealed against the elements.

While water-tight or sealed light fixtures are known, such enclosures are designed for conventional light sources, i.e., incandescent or halogen bulbs, and do not address the heat dissipation requirement of LED lights. In fact, the sealed fixture behaves as a thermal insulator and encloses the heat within the fixture. In conventional light bulbs there is no effective mechanism or even need to transfer heat from the light element or gases sealed within the bulb to ambient surroundings. Conventional light bulbs and fixtures carry a rating for a maximum wattage bulb that can be used in the fixture and therefore do not require a heat sink. Accordingly, conventional sealed fixtures have no effective heat transfer capability and therefore are not suitable for LED light engines, as the heat would be trapped within the fixture and reduce the life expectancy and reliability of the LEDs.

A need exists for an LED light engine compatible with a sealed or submersible fixture.

SUMMARY OF THE INVENTION

In one embodiment, the present invention is an LED light system comprising an enclosure having a housing with a form factor and a cover for sealing the enclosure. An LED module is inserted into the enclosure. The LED module includes (a) a shell having a matching form factor as the form factor of the housing for making physical contact with the housing over a surface area, (b) support structure, (c) substrate mounted on the support structure, (d) a plurality of LEDs disposed on the substrate, and (e) a heat transfer medium between the LEDs and the shell of the LED module.

In another embodiment, the present invention is an LED light module comprising an outer surface having a predetermined form factor, a support structure, a substrate mounted on the support structure, and a plurality of LEDs disposed on the substrate. A heat transfer medium is provided between the LEDs and the outer surface of the LED light module.

In another embodiment, the present invention is a method of making an LED light module comprising the steps of forming an outer surface having a predetermined form factor, providing a support structure, mounting a substrate on the support structure, disposing a plurality of LEDs on the substrate, and providing a heat transfer medium between the LEDs structure and the outer surface of the LED light module.

In another embodiment, the present invention is an LED light module comprising an outer surface having a predetermined form factor, a support structure, and an LED light engine mounted to the support structure. A heat transfer medium is provided between the LEDs and the outer surface of the LED light module.

DETAILED DESCRIPTION OF THE DRAWINGS

The present invention is described in one or more embodiments in the following description with reference to the Figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

LED lighting sources provide a brilliant light in many settings. LED lights are efficient, long-lasting, cost-effective, and environmentally friendly. LED lighting is rapidly becoming the light source of choice in many applications. In fact, it is desirable to extend LED lighting to outdoor settings or environments which are otherwise exposed to moisture and other elements such as wind and dust.

One important design aspect of LED lighting is the need for heat dissipation. Each LED in the light engine must maintain its rated junction temperature for maximum efficacy, longevity, and reliability. To expand the use of LED lighting to outdoor markets, it is important to address the heat dissipation requirement without unnecessarily restricting entry into the market by using total custom solutions. In other words, the outdoor light market exists with many standard fixtures. The LED light must integrate into that market without imposing unnecessary burdens on suppliers or causing redesign of established, known good and successful fixtures.

Figure 1:
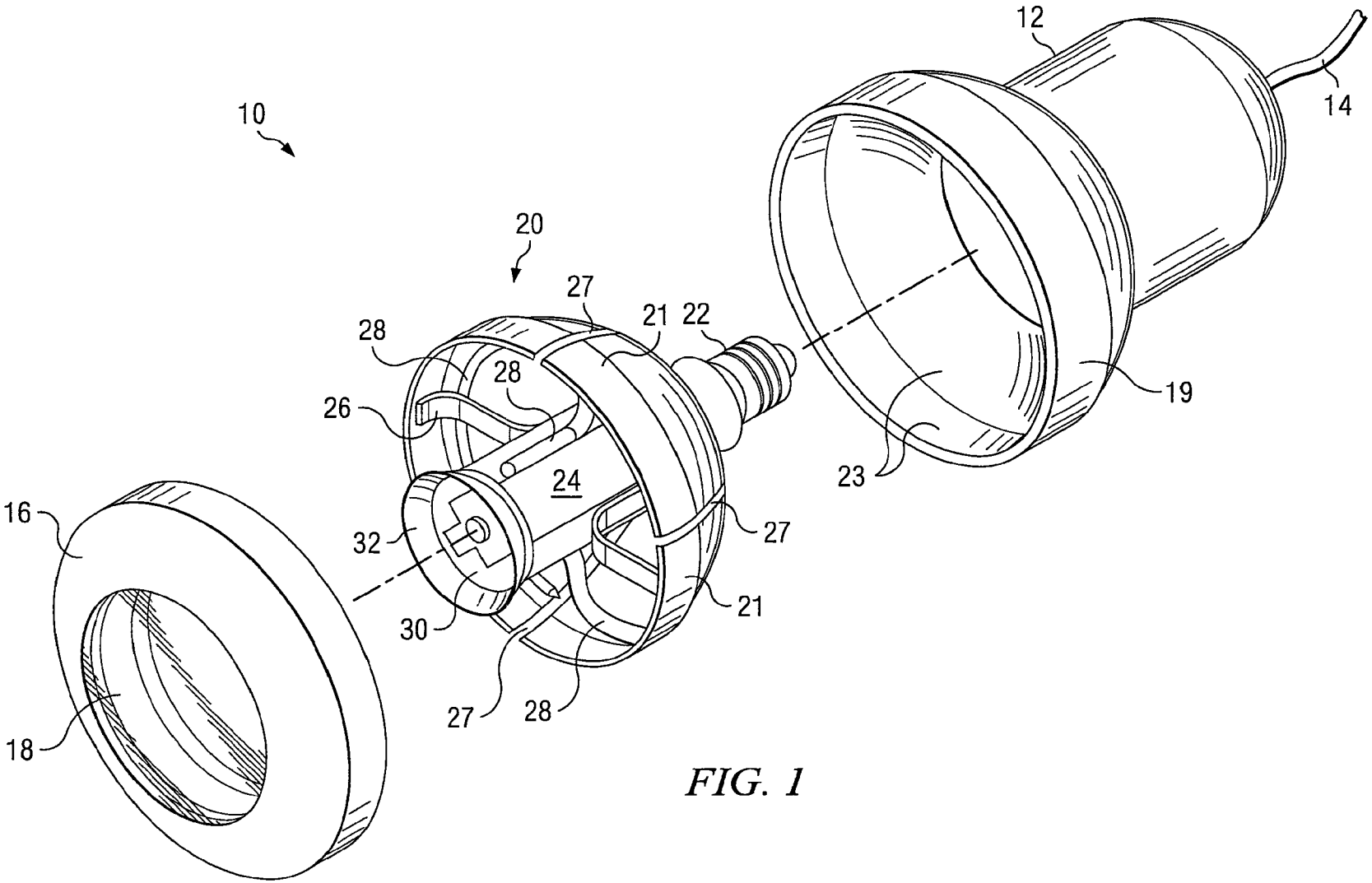
FIG. 1 is a sealed fixture enclosing an LED light module that uses a heat transfer agent to dissipate heat.

Referring to FIG. 1, lighting system 10 is shown with housing 12 suitable for sealing an interior portion of the housing against moisture and the elements found in outdoor settings. A power cord 14 extends from a back side of housing 12 to draw upon a source of alternating current (AC) power for lighting system 10. Housing cover 16 with lens 18 fits against surface 19 of housing 12 to form a water-tight, air-tight seal. In one embodiment, LED light system 10 can be used in areas exposed to rain, wind, snow, and dust. In another embodiment, LED light system 10 can be submersible, e.g., used for underwater lighting in swimming pools, spas, or fountains.

Housing 12 in combination with cover 16 and lens 18 constitute a standard fixture in many outdoor/underwater applications that use incandescent or halogen bulbs. LED light module 20 is made to fit into standard housing 12. AC power plug 22 mates with an AC power socket in housing 12 to draw AC power through power cord 14. LED light module 20 has an outer shell 21. Likewise, housing 12 has an outer shell 23. Shell 23 has a generally conical form factor which widens from the power cord end to the cover end of the housing. The conical shape may be linear, rounded or bell-shaped. Shell 23 may have other form factors as well. In any case, shell 21 is made with a matching or similar form factor as shell 23 so that a sufficient surface area of shell 21 makes physical contact with a sufficient surface area of shell 23 to provide good thermal transfer between the respective surfaces. A thermal interface pad can be added between shell 23 and shell 21 to enhance the thermal conduction and heat transfer.

LED light module 20 further includes support structure 24 extending from power plug 22. Push springs 26 are soldered or epoxy-bonded to support structure 24. Push springs 26 extend from support structure 24 and assert an outward force against the inner surface of shell 21 to hold the shell firmly against and in good thermal contact with shell 23 when inserted into housing 12. Shell 21 can be made with slots 27 to allow the surfaces of the shell to readily expand or bend outward due to the pressure asserted from push springs 26 to make firm contact with shell 23.

Heat pipes 28 are connected between support structure 24 and shell 21 of LED light module 20. Heat pipes 28 are soldered or epoxy-bonded to support structure 24. Heat pipes 28 run along a length of support structure 24 and then radiate outward with a curved shape to align along the inner surface of shell 21. Heat pipes 28 operate as part of a heat transfer agent or medium to provide a thermal conduction path from LED light engine 30 through support structure 24 to shell 21. In one embodiment, heat pipes 28 are hollow copper or aluminum vessels with an internal wicking structure and working fluid such as water or other fluid or gas. Alternatively, heat pipes 28 can be made of solid metal such as copper, aluminum or other thermally conductive material.

Support structure 24 also has a mounting platform for LED light engine or lamp 30. Reflector ring 32 surrounds LED light engine 30 and focuses the light emitted from the LEDs. Once LED module 20 is inserted into housing 12, lighting system 10 is sealed against moisture and other outdoor elements by housing cover 16 and lens 18.

Figure 2:
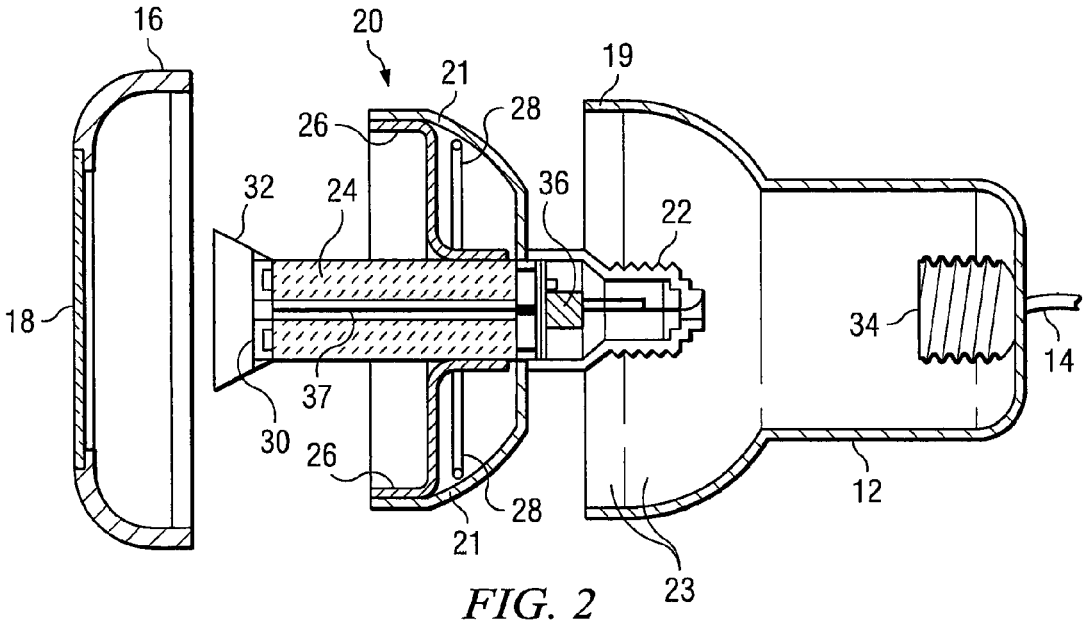
FIG. 2 illustrates a cross-sectional view of the sealed fixture and LED light module of FIG. 1.

FIG. 2 is a cross-sectional view of lighting system 10. When LED light module 20 is inserted into housing 12, the threads of AC plug 22 mate with the threads of AC socket 34 by rotating the module. The AC socket and plug shown in FIGS. 1 and 2 is an Edison E-type base. Alternately, the AC connection of LED light engine 20 can be made with a G-type, GU-type, B-type, or pin-type socket base. The outer surface of shell 21 physically contacts the inner surface of shell 23 with sufficient force to provide a good thermal connection when module 20 is fully inserted into housing 12. The contact between shells 21 and 23 is self-aligning by nature of having mating form factors and by the force asserted through push spring 26 and by tightening the threaded plug and socket. Heat pipes 28 connect between support structure 24 and the surface of shell 21. LED light engine 30 is positioned to emit light through lens 18 once housing cover 16 is in place to seal the fixture. Support structure 24 also contains a power conversion circuit 36 to convert the AC input voltage from power cord 14 to a direct current (DC) output voltage. The DC voltage is routed to LED light engine 30 by conductors 37.

Figure 3:
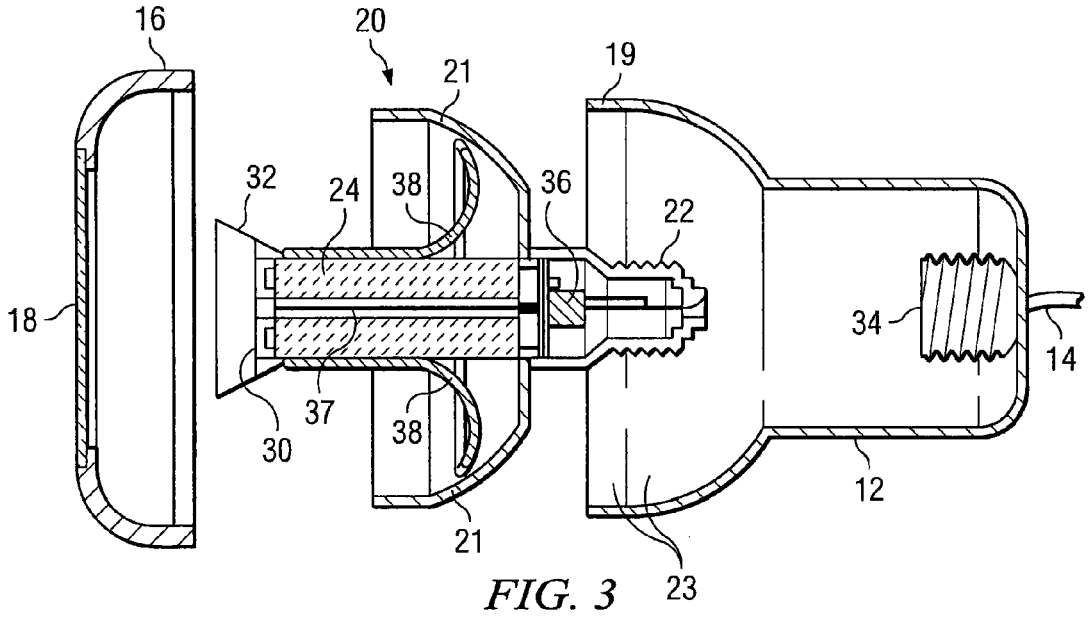
FIG. 3 illustrates a cross-sectional view of an alternate embodiment of the LED light module.

An alternate embodiment of LED light module 20 is shown in FIG. 3 without the push springs. When LED light module 20 is inserted into housing 12, the threads of AC plug 22 mate with the threads of AC socket 34 by rotating the module. If G-type, GU-type, or B-type base is used, a twist and lock action makes the AC connection. If pin-type base is used, push-in pin action makes the AC connection. In this embodiment, shell 21 is a one-piece solid component and heat pipes 38 serve as the thermal conduction path from LED light engine 30 through support structure 24 to shell 21. Heat pipes 38 are soldered or epoxy-bonded to support structure 24. Heat pipes 38 run along a length of support structure 24 and then radiate outward with a curved shape to align along the inner surface of shell 21. In one embodiment, heat pipes 38 can be formed with a spring tension to assert an outward force. The outer surface of shell 21 physically contacts the inner surface of shell 23 with sufficient force to provide good thermal connection when module 20 is fully inserted into housing 12. The contact between shells 21 and 23 is self-aligning by nature of having mating form factors and by the force asserted through the spring action of heat pipes 38 and by tightening the threaded plug and socket. LED light engine 30 is positioned to emit light through lens 18 once housing cover 16 is in place to seal the fixture. Support structure 24 contains power conversion circuit 36 to convert the AC voltage from power cord 14 to DC voltage. The DC voltage is routed to LED light engine 30 by conductors 37.

A single LED of light engine 30 can produce a bright light in the range of 1-5 watts and emit 55 lumens per watt with a life expectancy of about 100,000 hours. LED light engine 30 uses a bank or array of LEDs to increase the total luminance of light system 10. The LEDs generate heat during normal operation that must be dissipated to maintain individual LED junction temperatures within acceptable rated limits. Otherwise, the life expectancy and reliability of the light engine would decrease.

The heat generated by LED light engine 30 conducts through its substrate to support structure 24. Heat pipes 28 and 38 operate as part of a heat transfer agent or medium to dissipate the heat generated by LED light engine 30 from support structure 24 to shell 21 of LED light module 20, which in turn transfers the heat to shell 23 of housing 12 by the tight physical contact between the surfaces of the shells. The shells of LED module 20 and housing 12 are made of die cast metal, such as aluminum, copper, or other metal having good thermal conduction properties. Shell 21 acts to evenly spread heat over its entire surface and thus transfer maximum heat to shell 23 of housing 12. The heat is dissipated from housing 12 to the ambient surroundings.

Once fully assembled, light system 10 can be used in submersible applications or in any outdoor environment requiring a sealed or enclosed fixture. LED light module 20 can be inserted into any standard sealed fixture that supports other types of light sources, e.g., incandescent or halogen bulbs. Housing 12, cover 16, and lens 18 constitute such a standard fixture. LED light module 20 has a built-in heat transfer agent or medium, i.e., heat pipes 28 or 38, which transfers the heat generated by the LED light engine to shell 21 of the LED light module. The shell of housing 12 then becomes the final component to radiate the heat to ambient surroundings. The novel LED light module can be used in sealed fixtures that were originally designed without a heat dissipation capability. By transferring heat from the LED light engine through the support structure and heat pipes 28 or 38 to the shell of the LED light module, the natural heat dissipation properties of the housing enclosure can be exploited. LED lighting offers a low cost, power efficient, environmentally friendly, and safe alternative to conventional light sources. LED light module 20 is a drop-in replacement for conventional sealed fixtures. By using module 20, LED lighting can be substituted in existing fixtures without retrofitting the enclosures or utilizing special tools.

Figure 4:
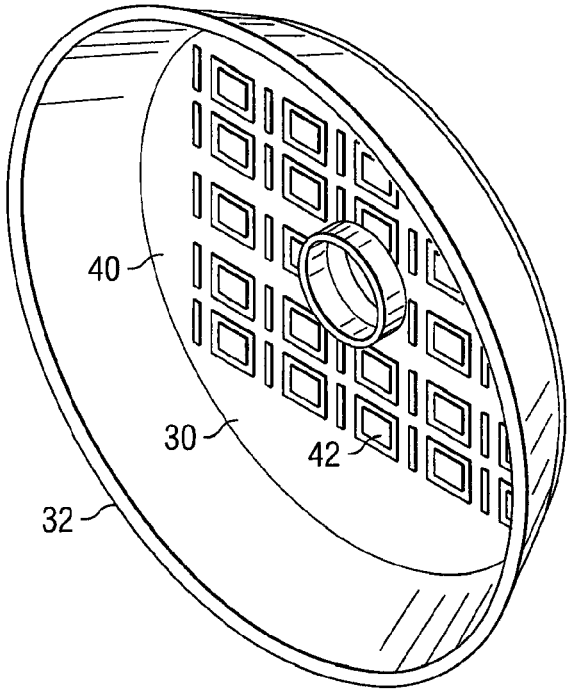
FIG. 4 illustrates further detail of the light engine.

FIG. 4 shows further detail of LED light engine 30 and reflector ring 32. LED light engine 30 includes a high thermal conductivity substrate 40 and an array of LED semiconductor devices 42 mechanically connected to the substrate. Substrate 40 provides structural support for LED devices 42. Substrate 40 is a metal-clad printed circuit board (PCB) or other structure having good thermal conduction properties to dissipate the heat generated by LED devices 42. For example, substrate 40 has a thermal conductivity greater than 1 W/° K-m. Such metal clad PCBs may be fabricated using conventional FR-4 PCB processes, and are therefore relatively cost-effective. Other suitable substrates include various hybrid ceramics substrates and porcelain enamel metal substrates. Furthermore, by applying white masking on the substrate and silver-plating the circuitry, the light reflection from the substrate can be enhanced.

A transparent polymeric encapsulant, e.g., optical-grade silicone, is formed over the LED semiconductor devices 42. The encapsulant is disposed on LED devices 42 and then suitably cured to provide a protective layer. The protective encapsulant layer is soft to withstand the thermal excursions to which the LED light module is subjected without fatiguing the die, wire bonds, and other components. The properties of the encapsulant can be selected to achieve other optical properties, e.g., filtering of the light produced by LED devices 42.

Reflector ring 32 is conic, parabolic, or angular in shape and fixed to substrate 40 to assist in directing and has a smooth, polished, mirror-like inner surface for focusing light, or using a faceted inner surface for mixing of light from two or more LED devices having different colors. LED devices 42 are located at the base of reflector ring 32. In other embodiments, one or more optical components such as filters, lenses, and the like are fixed to the encapsulant.

Figure 5:
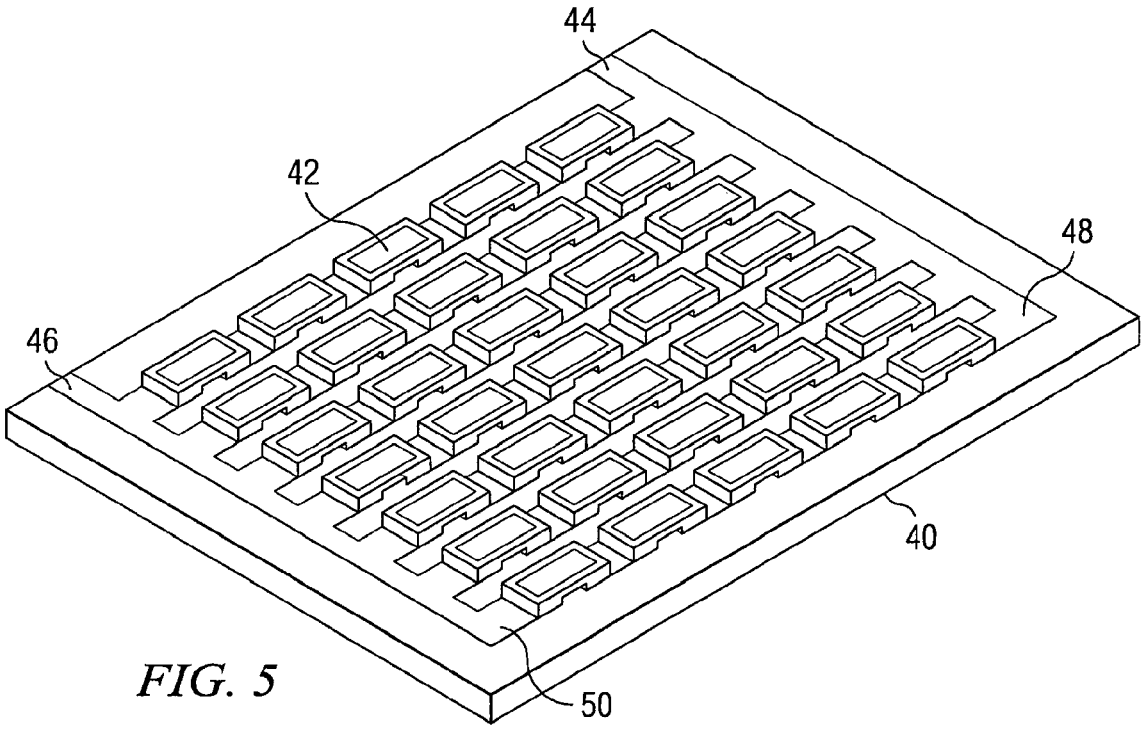
FIG. 5 illustrates the layout of surface-mounted LEDs on the substrate.

FIG. 5 shows the connectivity of LED light engine 30. A plurality of LED semiconductor devices 42 are surface mounted to substrate 40. The DC voltage from conductors 37 is applied across terminals 44 and 46. The DC voltage is routed through metal conductors or trace patterns 48 and 50 to supply operating potential to LED devices 42. LED devices 42 can also be interconnected with wire bonds or solder bonds. LED devices 42 may be connected in electrical parallel configuration or electrical series configuration or combination thereof. FIG. 5 illustrates seven structures in electrical parallel and five LED devices 42 in series in each parallel path, for illustration purposes. Moreover, LED devices 42 can be positioned in a rectilinear pattern, a circular or curvilinear pattern, a random or stochastic pattern, or any combination thereof. The LED devices can be laid out in multiple regions, where each of the regions exhibits different patterns and numbers of devices.

The number of LED devices 42 incorporated into the device may be selected in accordance with a number of design variables, such as type of power source, forward voltage ($V_f$) or power rating of each LED, and desired color combination. For example, LED devices 42 can be connected in series or parallel such that the overall combined $V_f$ of the LED devices matches the electrical input. In one embodiment, 40 to 80 LED devices can be electrically connected in series, depending upon the $V_f$ of the individual LEDs. By matching the combined forward voltage of the LEDs with the voltage of the input source, the power supply for the light engine can be simplified such that no bulky, complicated voltage step-up or step-down transformers, or switching power supply which all have conversion losses, need be used in connection with the system. In some cases, the switching power supply can be used in a constant current configuration.

LED devices 42 are manufactured using one or more suitable semiconductor materials, including, for example, GaAsP, GaP, AlGaAs AlGaInP, GaInN, or the like. The LED devices may be 300×300 micron square die with a thickness of about 100 microns. The individual LED devices have particular colors corresponding to particular wavelengths or frequencies. Multiple LEDs of various colors, e.g., red, green, and blue, can produce the desired color of emitted light.

Figure 6:
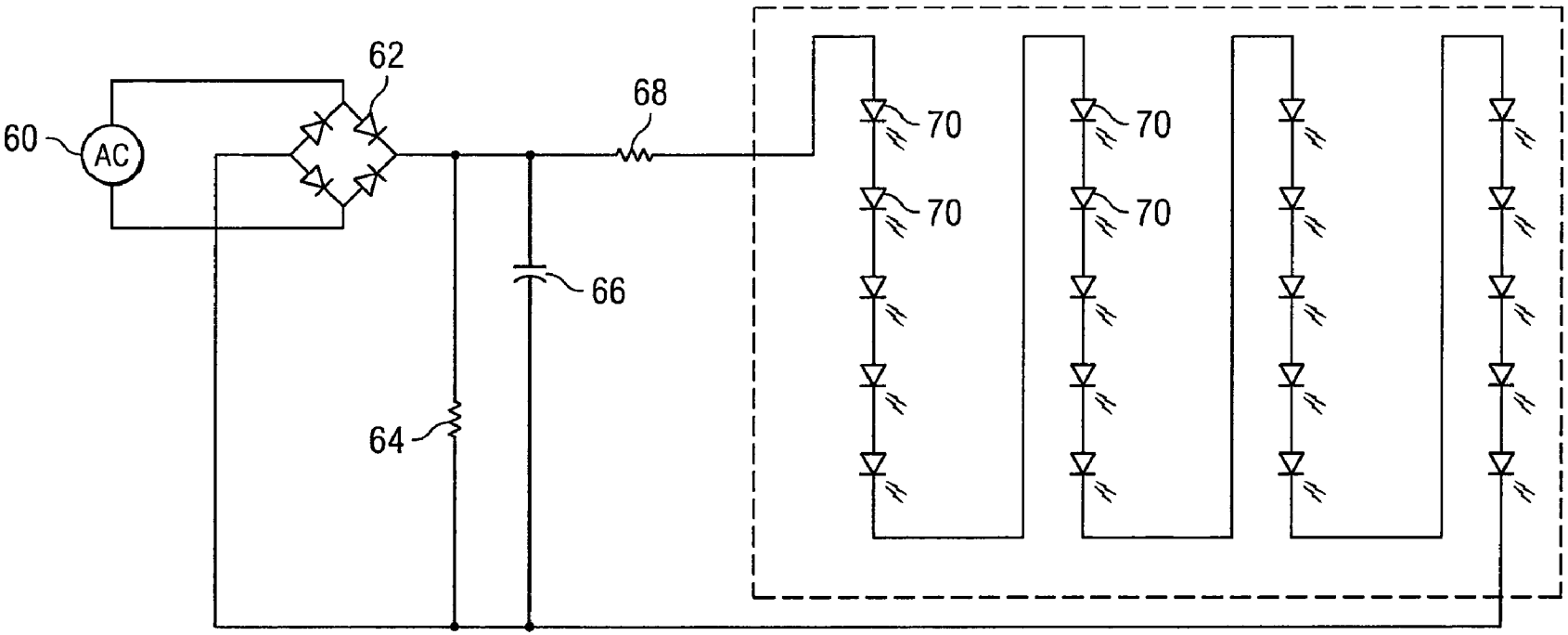
FIG. 6 is a schematic drawing of the light engine.

FIG. 6 is a schematic diagram of the electrical connection of the LED devices. AC power source 60 is converted to a DC voltage by full-wave rectifier 62, resistor 64, and capacitor 66. The DC voltage is routed through current limiting resistor 68 to LEDs 70. LEDs 70 are shown in FIG. 6 as connected in series. The DC voltage energizes the plurality of LEDs to produce light. The LEDs also generate heat which is dissipated through substrate 40, support structure 24, heat pipes 28 or 38, shell 21 of LED light module 20, and shell 23 of housing 12, as described above.

Figure 7A:
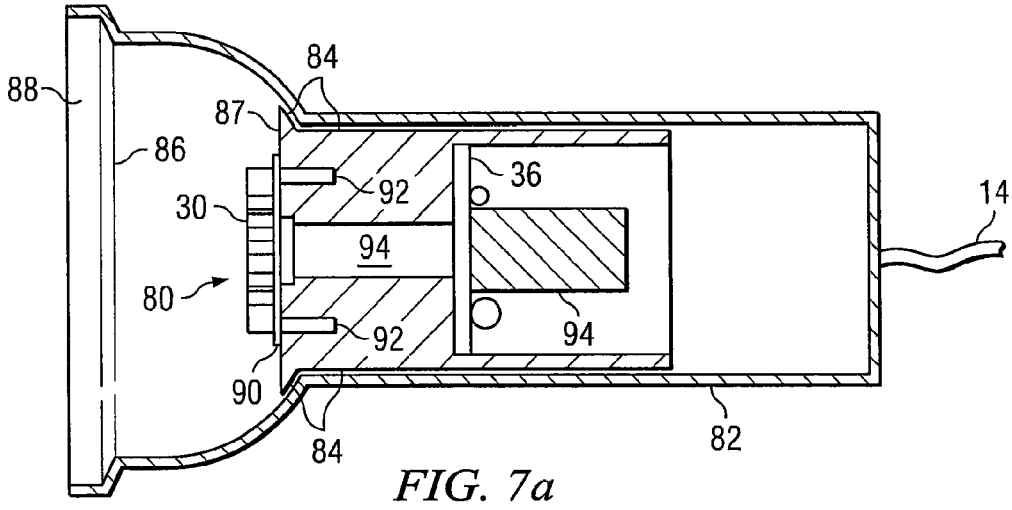
FIGS. 7*a*-7*c* illustrate an alternate embodiment of the sealed fixture and LED light module.

Another embodiment of the LED light module is shown in cross-sectional view as FIG. 7*a*. LED light module 80 is inserted into housing 82, which is sealable against moisture and outside elements. The outer surface or shell of module 80 physically contacts the inner surface of housing 82 via contact areas 84 with sufficient force to provide a good thermal connection when module 80 is fully inserted into housing 82. The contact between module 80 and housing 82 is self-aligning by nature of having mating form factors. Notice that a portion of contact area 84 between module 80 and housing 82 resides in a shaft portion of housing 82 and a portion of contact area 84 resides in a bell-shaped portion of housing 82. LED light engine 30 is positioned to emit light through lens 86 once housing cover 88 is in place to seal the fixture. Support structure 94 also contains a power conversion circuit 36 to convert the AC input voltage from power cord 14 to a DC output voltage. The thermal conduction path follows from LED light engine 30 through substrate 90 to support structure 94, which physically contacts the outer surface of module 80 by fastening screw 92. Module 80 provides a continuous thermal conduction path from LED light engine 30 to the outer surface of the module, which acts to evenly spread heat over its entire surface and transfer maximum heat. The heat is transferred from the outer surface of module 80 to the inner surface of housing 82 to radiate the heat to ambient surroundings.

Figure 7B:
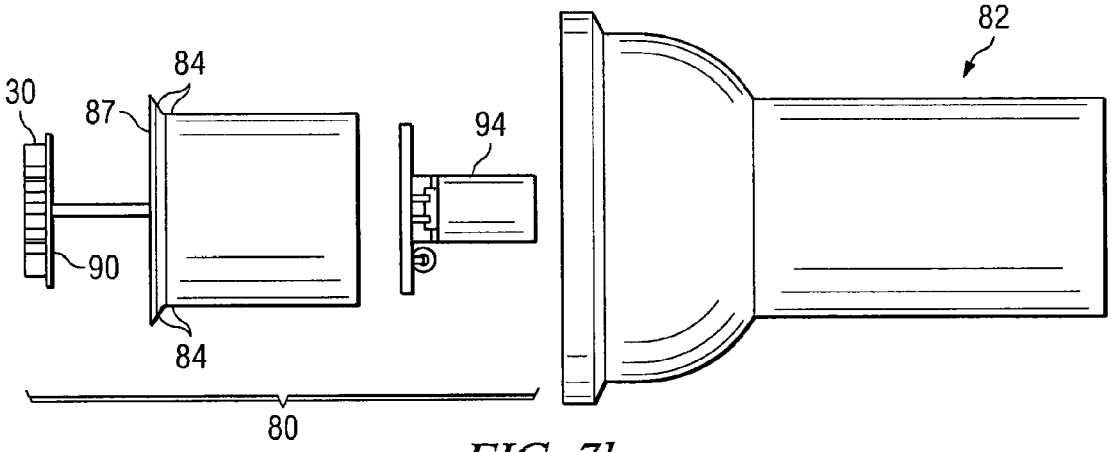

Another view of LED light module 80 is shown in FIG. 7*b*. The outer surface or shell of module 80 physically contacts the inner surface of housing 82 via contact areas 84 with sufficient force to provide a good thermal connection when module 80 is fully inserted into housing 82. LED light engine 30 is supported by substrate 90 to top surface 87 of module 80. The thermal conduction path follows from LED light engine 30 through substrate 90, which physically contacts the outer surface of module 80. Module 80 provides a continuous thermal conduction path from LED light engine 30 to the outer surface of the module, which acts to evenly spread heat over its entire surface and transfer maximum heat. The heat is transferred from the outer surface of module 80 to the inner surface of housing 82 to radiate the heat to ambient surroundings.

Figure 7C:
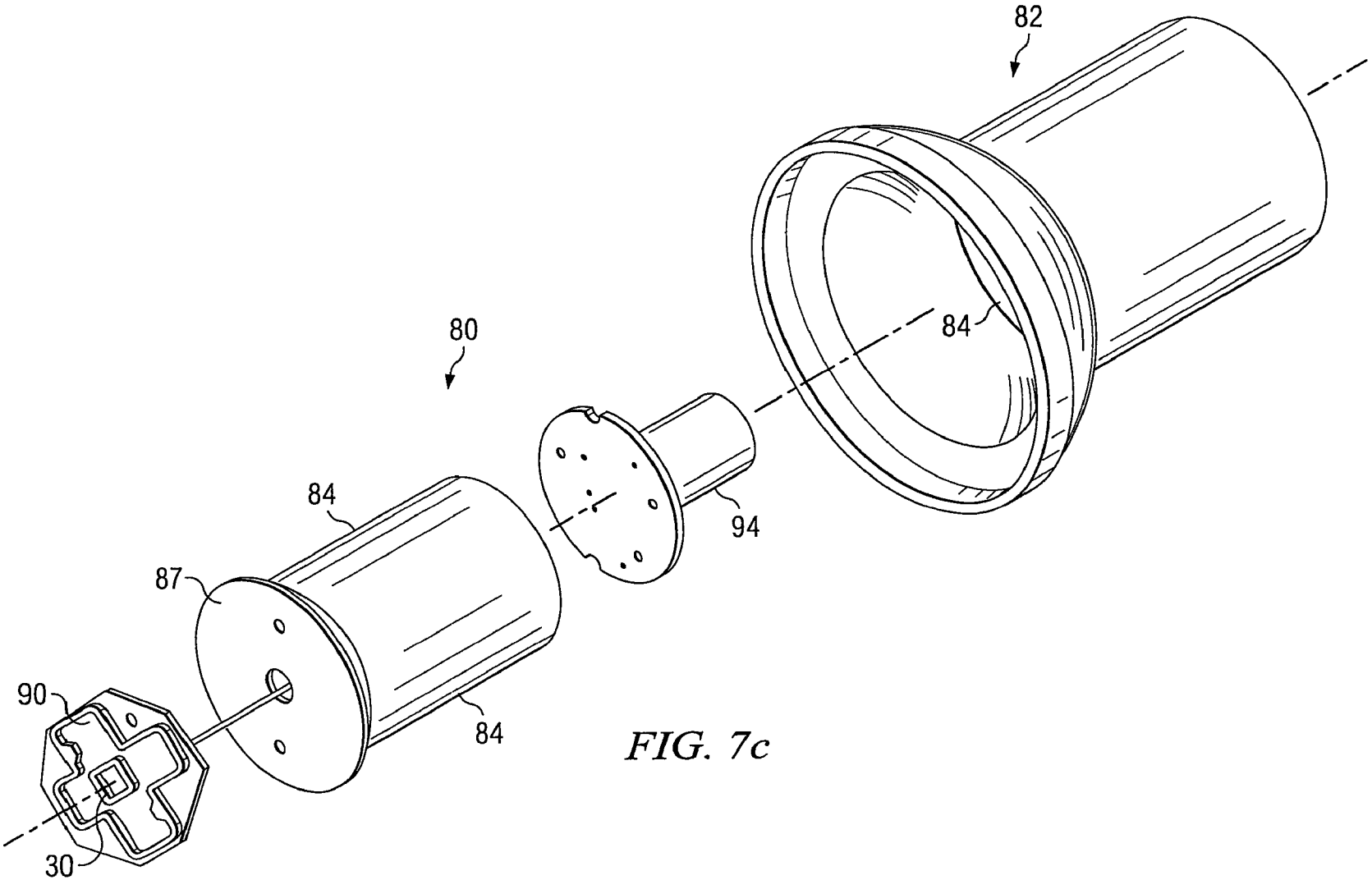

FIG. 7*c* is an orthogonal view of LED light module 80 inserted into housing 82 and sealable against moisture and outside elements. The outer surface or shell of module 80 physically contacts the inner surface of housing 82 via contact areas 84 with sufficient force to provide a good thermal connection when module 80 is fully inserted into housing 82. LED light engine 30 is supported by substrate 90 to top surface 87 of module 80. The thermal conduction path follows from LED light engine 30 through substrate 90, which physically contacts the outer surface of module 80. Module 80 provides a continuous thermal conduction path from LED light engine 30 to the outer surface of the module, which acts to evenly spread heat over its entire surface and transfer maximum heat. The heat is transferred from the outer surface of module 80 to the inner surface of housing 82 to radiate the heat to ambient surroundings. In FIG. 7*a*-7*c*, the continuous thermal conduction path between the LED light engine and outer surface of the module operates as the heat transfer agent or medium to dissipate the heat generated by the LED light engine.

Figure 8:
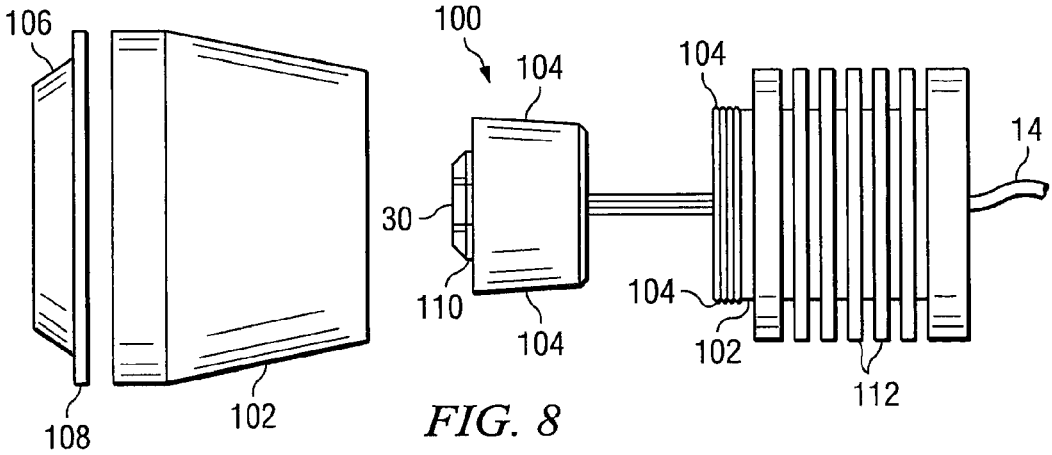
FIG. 8 illustrates an alternate embodiment of the sealed fixture and LED light module.

Another embodiment of the LED light module is shown in cross-sectional view as FIG. 8. LED light module 100 is inserted into housing 102, which is sealable against moisture and outside elements. The outer surface or shell of module 100 physically contacts the inner surface of housing 102 via contact areas 104 with sufficient force to provide a good thermal connection when module 100 is fully inserted into housing 102. The contact between module 100 and housing 102 is self-aligning by nature of having mating form factors. LED light engine 30 is positioned to emit light through lens 106. Lens 106 can be a flat, concave, convex or Fresnel lens. The thermal conduction path follows from LED light engine 30 through substrate 110, which physically contacts the outer surface of module 100. Module 100 provides a continuous thermal conduction path from LED light engine 30 to the outer surface of the module, which acts to evenly spread heat over its entire surface and transfer maximum heat. The heat is transferred from the outer surface of module 100 to the inner surface of housing 102 to radiate the heat to ambient surroundings. Housing 102 contains fins 112 for additional heat dissipation.

Figure 9:
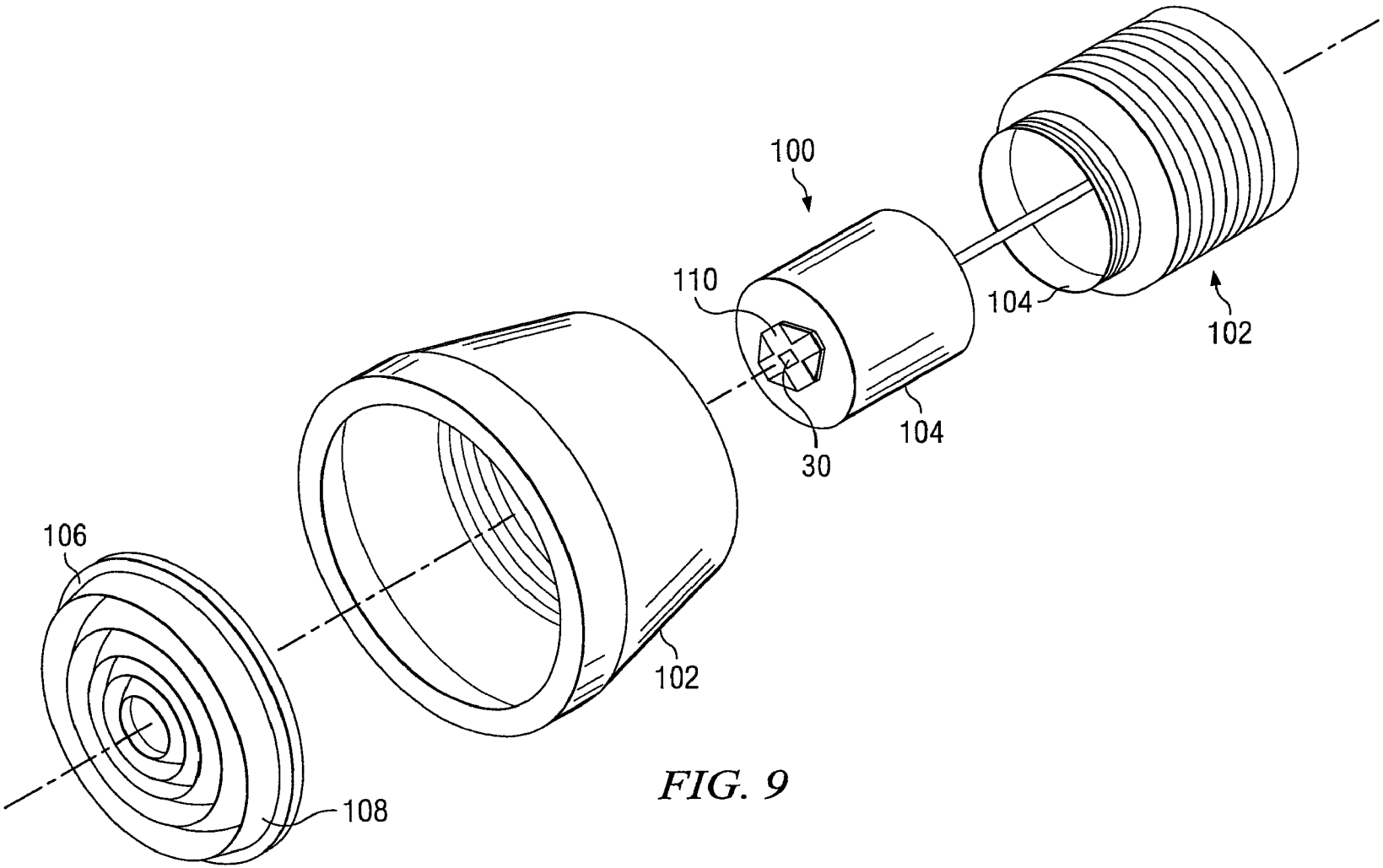
FIG. 9 illustrates an orthogonal view of the sealed fixture and LED light module of FIG. 8.

FIG. 9 is an orthogonal view of LED light module 100 inserted into housing 102 and sealable against moisture and outside elements. The outer surface or shell of module 100 physically contacts the inner surface of housing 102 via contact areas 104 with sufficient force to provide a good thermal connection when module 100 is fully inserted into housing 102. The contact between module 100 and housing 102 is self-aligning by nature of having mating form factors. The thermal conduction path follows from LED light engine 30 through substrate 110, which physically contacts the outer surface of module 100 as seen in FIG. 9. Module 100 provides a continuous thermal conduction path from LED light engine 30 to the outer surface of the module, which acts to evenly spread heat over its entire surface and transfer maximum heat. The heat is transferred from the outer surface of module 100 to the inner surface of housing 102 to radiate the heat to ambient surroundings.

Figure 10:
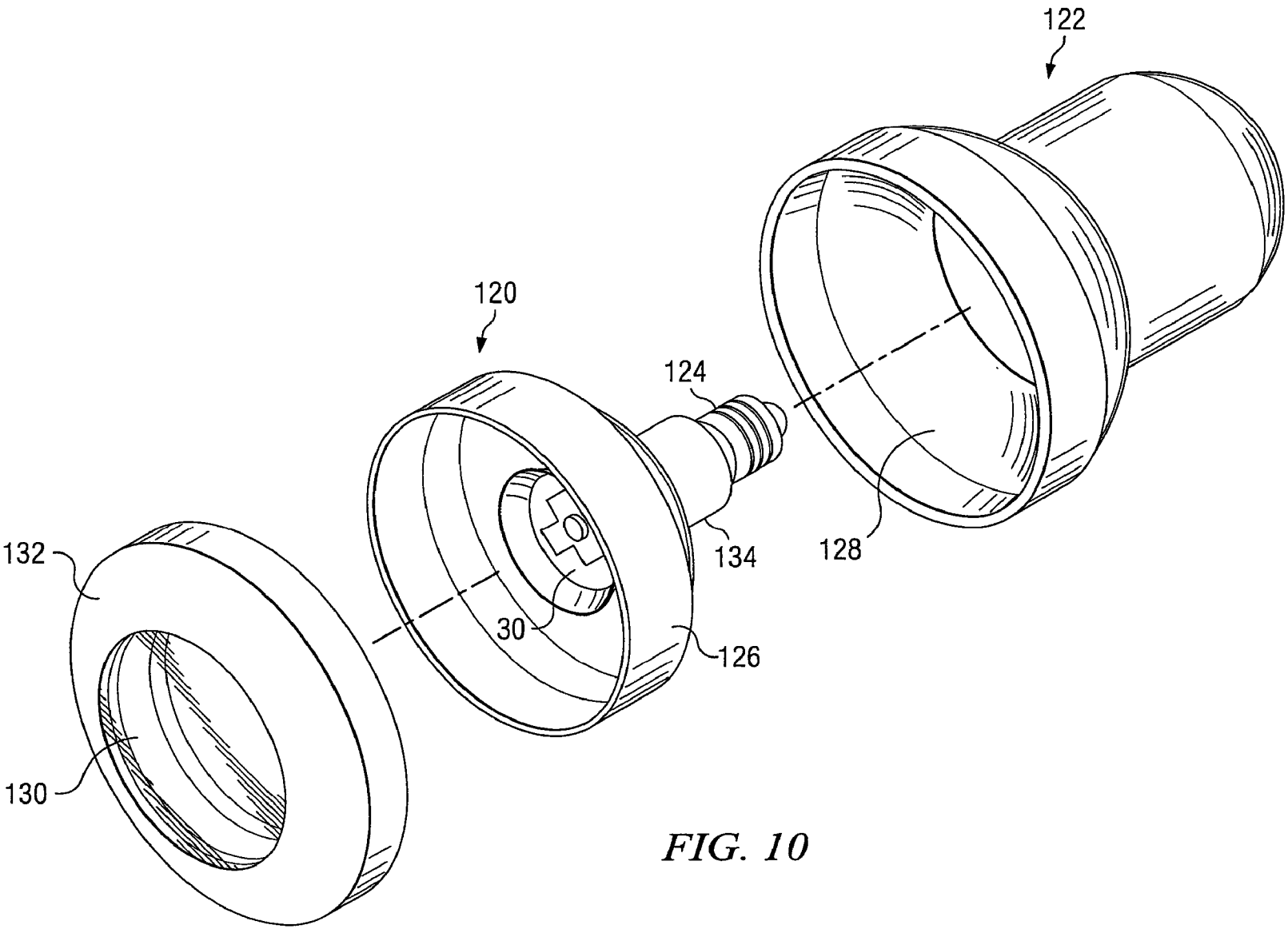
FIG. 10 illustrates an alternate embodiment of the sealed fixture and LED light module.

Another embodiment of the LED light module is shown in FIG. 10. When LED light module 120 is inserted into housing 122, the threads of AC plug 124 mate with the threads of the AC socket by rotating the module. Housing 122 is sealable against moisture and outside elements. The outer surface of shell 126 physically contacts the inner surface of shell 128 with sufficient force to provide good thermal connection when module 120 is fully inserted into housing 122. The contact between shells 126 and 128 is self-aligning by nature of having mating form factors. LED light engine 30 is positioned to emit light through lens 130 once housing cover 132 is in place to seal the fixture. The thermal conduction path follows from LED light engine 30 through support structure 134, which physically contacts the outer surface of module 120. Module 120 provides a continuous thermal conduction path from LED light engine 30 to the outer surface of the module, which acts to evenly spread heat over its entire surface and transfer maximum heat. The heat is transferred from the outer surface of module 120 to the inner surface of housing 122 to radiate the heat to ambient surroundings.

Figure 11:
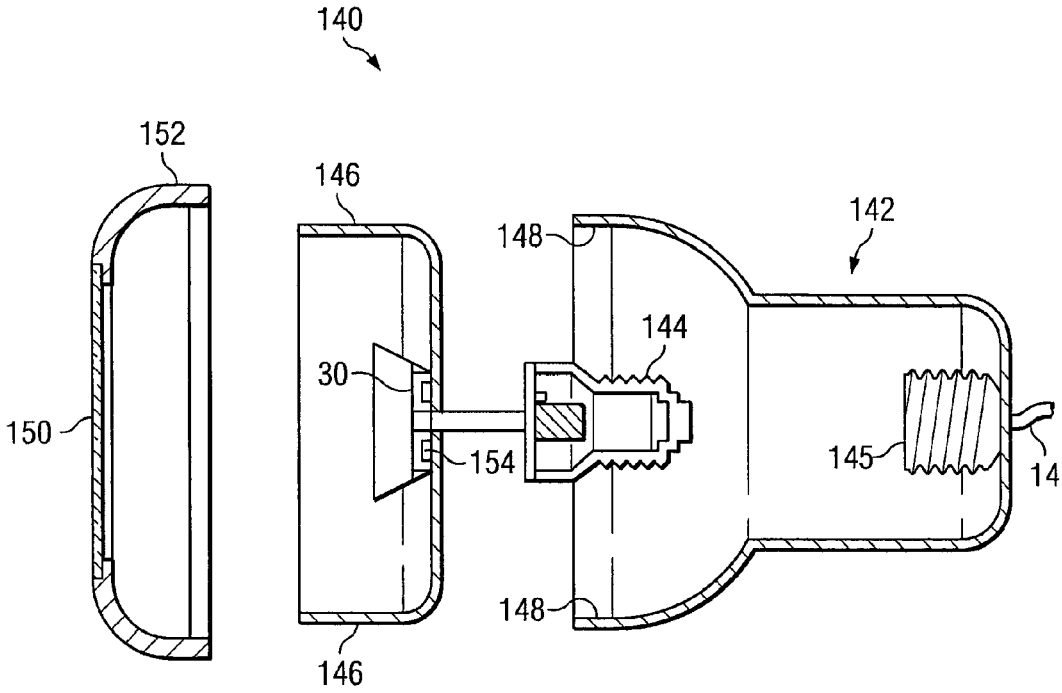
FIG. 11 illustrates an alternate embodiment of the sealed fixture and LED light module.

Another embodiment of the LED light module is shown in FIG. 11, which is similar to FIG. 10 although shell 146 and AC plug 144 are connected by a pair of flexible lead wires. The threads of AC plug 144 mates with the threads of AC socket 145 by rotating the base. The arrangement allows an easy field installation whereby housing 142 is sealable against moisture and outside elements. The outer surface of shell 146 physically contacts the inner surface of shell 148 with sufficient force to provide good thermal connection when module 140 is fully inserted into housing 142. The contact between shells 146 and 148 is self-aligning by nature of having mating form factors. LED light engine 30 is positioned to emit light through lens 150 once housing cover 152 is in place to seal the fixture. The thermal conduction path follows from LED light engine 30 through substrate 154, which physically contacts the outer surface of shell 146. Module 140 provides a continuous thermal conduction path from LED light engine 30 to the outer surface of the module, which acts to evenly spread heat over its entire surface and transfer maximum heat. The heat is transferred from the outer surface of shell 146 to the inner surface of shell 148 to radiate the heat to ambient surroundings. In FIGS. 8-11, the continuous thermal conduction path between the LED light engine and outer surface of the module operates as the heat transfer agent or medium to dissipate the heat generated by the LED light engine.

In summary, the LED light module can be inserted into any standard sealed fixture that supports other types of light sources, e.g., incandescent or halogen bulbs. The built-in heat transfer agent or medium, i.e., heat pipes 28 or 38 or other continuous thermal conduction path, of the LED light module transfers the heat generated by the LED light engine to the outer surface of the LED light module, which in turn radiates the heat through the housing to ambient surroundings. Thus, the novel LED light module can be used in sealed fixtures that were originally designed without a heat dissipation capability. By transferring heat from the LED light engine through the continuous heat transfer medium to the shell of the LED light module, the natural heat dissipation properties of the housing enclosure can be exploited in existing fixtures without retrofitting the enclosures or utilizing special tools.

While one or more embodiments of the present invention have been illustrated in detail, the skilled artisan will appreciate that modifications and adaptations to those embodiments may be made without departing from the scope of the present invention as set forth in the following claims.

What is claimed is:

1. An LED light system, comprising:

a standard housing having conical or cubic form factor, the standard housing having non-ribbed exterior and interior surfaces; and an LED module for inserting into the housing, the LED module including, (a) a shell having a matching form factor as the conical or cubic form factor of the housing for making physical contact with the housing over the interior surface, (b) a support structure, (c) a substrate mounted on the support structure, (d) a plurality of LEDs disposed on the substrate, and (e) a heat transfer medium between the LEDs and the shell of the LED module and the housing.

2. The LED light system of claim 1, wherein the heat transfer medium is made of a thermally conductive material.

3. The LED light system of claim 2, wherein the thermally conductive material contains aluminum or copper.

4. The LED light system of claim 1, wherein the heat transfer medium includes heat pipes in contact with the support structure and formed to contact a surface area of the shell.

5. The LED light system of claim 1, wherein the LED light module further includes a power converter which receives an AC input voltage and provides a DC output voltage to the LEDs.

6. The LED light system of claim 1, wherein the LED light module further includes a reflector ring surrounding the LEDs.

7. An LED light system, comprising:

an enclosure having a housing with a form factor and cover for sealing the enclosure; and an LED module for inserting into the enclosure, the LED module including, (a) a shell having a matching form factor as the form factor of the housing for making physical contact with the housing over a surface area, (b) a support structure, (c) a substrate mounted on the support structure, (d) a plurality of LEDs disposed on the substrate, (e) a heat transfer medium between the LEDs and the shell of the LED module, and (f) a push spring mounted to the support structure for asserting force against the shell.

8. An LED light module, comprising:

an outer surface having a predetermined form factor with a plurality of slots to allow the outer surface to expand;

a support structure;

a substrate mounted on the support structure;

a plurality of LEDs disposed on the substrate; and a heat transfer medium between the LEDs and the outer surface of the LED light module.

9. The LED light module of claim 8, wherein the predetermined form factor of the outer surface of the LED light module is adapted for contacting a surface area of an enclosure.

10. The LED light module of claim 8, wherein the heat transfer medium is made of a thermally conductive material.

11. The LED light module of claim 10, wherein the thermally conductive material contains aluminum or copper.

12. The LED light module of claim 8, wherein the heat transfer medium includes heat pipes in contact with the support structure and formed to contact a surface area of the LED light module.

13. The LED light module of claim 8, further including a power converter which receives an AC input voltage and provides a DC output voltage to the LEDs.

14. An LED light module, comprising:

an outer surface having a predetermined form factor;

a support structure;

a substrate mounted on the support structure;

a plurality of LEDs disposed on the substrate;

a heat transfer medium between the LEDs and the outer surface of the LED light module; and a push spring mounted to the support structure for asserting force against the outer surface of the LED light module.

15. The LED light module of claim 8, further including a reflector ring surrounding the LEDs.

16. A method of making an LED light module, comprising:

forming an outer surface having a predetermined form factor with a plurality of slots to allow the outer surface to expand;

providing a support structure;

mounting a substrate on the support structure;

disposing a plurality of LEDs on the substrate; and providing a heat transfer medium between the LEDs and the outer surface of the LED light module.

17. The method of claim 16, wherein the predetermined form factor of the outer surface of the LED light module is adapted for contacting a surface area of an enclosure.

18. The method of claim 16, wherein the heat transfer medium is made of a thermally conductive material.

19. The method of claim 18, wherein the thermally conductive material contains aluminum or copper.

20. The method of claim 16, further including forming heat pipes from the support structure to contact a surface area of the LED light module.

21. An LED light module, comprising:

an outer surface having a predetermined form factor with a plurality of slots to allow the outer surface to expand;

a support structure;

an LED light engine mounted to the support structure; and a heat transfer medium between the LEDs and the outer surface of the LED light module.

22. The LED light module of claim 21, wherein the LED light engine includes:

substrate mounted on the support structure; and a plurality of LEDs disposed on the substrate.

23. The LED light module of claim 21, wherein the predetermined form factor of the outer surface of the LED light module is adapted for contacting a surface area of an enclosure.

24. The LED light module of claim 21, wherein the heat transfer medium is made of a thermally conductive material.

25. The LED light module of claim 24, wherein the thermally conductive material contains aluminum or copper.

26. The LED light module of claim 21, wherein the heat transfer medium includes heat pipes in contact with the support structure and formed to contact a surface area of the LED light module.

27. An LED light module, comprising:

an outer surface having a predetermined form factor;

a support structure;

an LED light engine mounted to the support structure;

a heat transfer medium between the LEDs and the outer surface of the LED light module; and a push spring mounted to the support structure for asserting force against the outer surface of the LED light module.

* * * * *